US007129898B1

(12) United States Patent
Chou

(10) Patent No.: US 7,129,898 B1
(45) Date of Patent: Oct. 31, 2006

(54) ANTENNA ASSEMBLY HAVING DIFFERENT SIGNAL EMITTING DIRECTION

(75) Inventor: Tung Sheng Chou, Tauyuan Hsien (TW)

(73) Assignee: Joymax Electronics Co., Ltd., Tauyuan Hsien (TW)

( * ) Notice: Subject to any disclaimer, the term of this patent is extended or adjusted under 35 U.S.C. 154(b) by 0 days.

(21) Appl. No.: 11/069,676

(22) Filed: Mar. 1, 2005

(51) Int. Cl.
*H01Q 1/38* (2006.01)

(52) U.S. Cl. ..... 343/700 MS; 343/702

(58) Field of Classification Search ..... 343/810, 343/700 MS
See application file for complete search history.

(56) References Cited

U.S. PATENT DOCUMENTS 5,898,405 A * 4/1999 Iwasaki ..... 343/700 MS
6,342,868 B1 * 1/2002 Tsai et al. ..... 343/795
6,400,332 B1 * 6/2002 Tsai et al. ..... 343/795
6,424,311 B1 * 7/2002 Tsai et al. ..... 343/795
6,486,834 B1 11/2002 Tsai ..... 343/702
6,940,458 B1 * 9/2005 Mukai et al. ..... 343/700 MS
2004/0090373 A1 5/2004 Faraone et al.
2004/0119642 A1 6/2004 Truthan

* cited by examiner

*Primary Examiner*—Mohammad Ali
*Assistant Examiner*—Binh Va Ho
(74) *Attorney, Agent, or Firm*—Charles E. Baxley

(57) ABSTRACT

An antenna assembly includes a circuit board, and one antenna device disposed on one side of the circuit board, for receiving and transmitting signals laterally, and another antenna device disposed on the other side of the circuit board, for receiving and transmitting signals vertically, to prevent the signal receiving and transmitting operations of the antenna devices from being interfered with each other. The antenna devices each includes two antenna members for receiving and transmitting signals toward different directions relative to each other, and each having two or more antenna segments for receiving and transmitting signals of different frequencies.

1 Claim, 5 Drawing Sheets

ANTENNA ASSEMBLY HAVING DIFFERENT SIGNAL EMITTING DIRECTION

BACKGROUND OF THE INVENTION

1. Field of the Invention

The present invention relates to an antenna assembly, and more particularly to an antenna assembly having different poles or different antenna members or devices for receiving and transmitting signals toward different directions.

2. Description of the Prior Art

Typical antenna devices comprise an antenna disposed on or applied onto one side of a printed circuit board (PCB), for receiving and transmitting electric signals. Some of the typical antenna devices may further comprise a metal sheet disposed on or applied onto the other side of the PCB, for grounding purposes.

For example, U.S. Pat. No. 6,486,834 to Tsai discloses one of the typical antenna devices and also comprises an antenna disposed on or applied onto one side of a PCB, for receiving and transmitting electric signals, and a metal sheet disposed on or applied onto the other side of the PCB, for grounding purposes, and a cable including a core wire and a ground shield coupled to the antenna and the metal sheet respectively.

However, the antenna is disposed on one side of the PCB, and the magnetic field generated by the antenna may be polarized. For example, as shown in FIG. 1, the antenna 11 disposed on one side of the PCB 10 may generate magnetic fields 12 that may also be polarized and may have two poles 13, 14 or two dead ends or dead corners where electric signals may not be suitably received and transmitted.

U.S. Patent Application No. US 2004/0090373 A1 to Faraone et al. discloses another typical antenna device which also comprises an antenna disposed on or applied onto one side of a PCB, for receiving and transmitting electric signals, and a ground plane area disposed on or applied onto the same side of the PCB, for grounding purposes.

However, similarly, the antenna is disposed on one side of the PCB, and the magnetic field generated by the antenna may also be polarized, such that the signals also may not be suitably received and transmitted by typical antenna device.

U.S. Patent Application No. US 2004/0090373 A1 to Truthan discloses a further typical antenna device which also comprises an antenna disposed on or applied onto one side of a PCB, for receiving and transmitting electric signals. However, similarly, the antenna is disposed on one side of the PCB, and the magnetic field generated by the antenna may also be polarized, such that the signals also may not be suitably received and transmitted by typical antenna device.

The present invention has arisen to mitigate and/or obviate the afore-described disadvantages of the conventional antenna assemblies.

SUMMARY OF THE INVENTION

The primary objective of the present invention is to provide an antenna assembly including two antenna devices disposed on different sides of a circuit board for receiving and transmitting signals toward different directions, such as horizontally or laterally, and vertically or upwardly and downwardly.

The other objective of the present invention is to provide an antenna assembly including different antenna members or segments for receiving and transmitting signals of different or various frequencies.

In accordance with one aspect of the invention, there is provided an antenna assembly comprising a circuit board including a first side and a second side, a first antenna device disposed on the first side of the circuit board, for receiving and transmitting signals laterally, and a second antenna device disposed on the second side of the circuit board, for receiving and transmitting signals vertically, to prevent signal receiving and transmitting operations of the first and the second antenna devices from being interfered with each other.

The first antenna device includes two antenna members for receiving and transmitting signals toward different directions relative to each other. The antenna members of the first antenna device are disposed side by side relative to each other. For example, the antenna members of the first antenna device are disposed in mirror symmetric relative to each other.

The antenna members of the first antenna device each includes a first antenna segment and a second antenna segment for receiving and transmitting signals of different frequencies. It is preferable that the first and the second antenna segments of each of the antenna members of the first antenna device are disposed up and down relative to each other.

The antenna members of the first antenna device each includes an intermediate antenna segment disposed between the first and the second antenna segments. The intermediate antenna segments of the antenna members of the first antenna device each includes an extension extended outwardly therefrom, for coupling to an electric cable, and thus for allowing the antenna members or segments to receive and transmit signals of various frequencies.

The second antenna device includes two antenna members for receiving and transmitting signals toward different directions relative to each other. The antenna members of the second antenna device are disposed up and down relative to each other. For example, the antenna members of the second antenna device are disposed in mirror symmetric relative to each other.

The antenna members of the second antenna device each includes a first antenna segment and a second antenna segment for receiving and transmitting signals of different frequencies. The first and the second antenna segments of each of the antenna members of the second antenna device are disposed side by side relative to each other.

The antenna members of the second antenna device each includes a base antenna segment having the first and the second antenna segments extended therefrom. The base antenna segments of the antenna members of the second antenna device each includes one end for coupling to an electric cable, and thus for allowing the antenna members or segments to receive and transmit signals of various frequencies.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
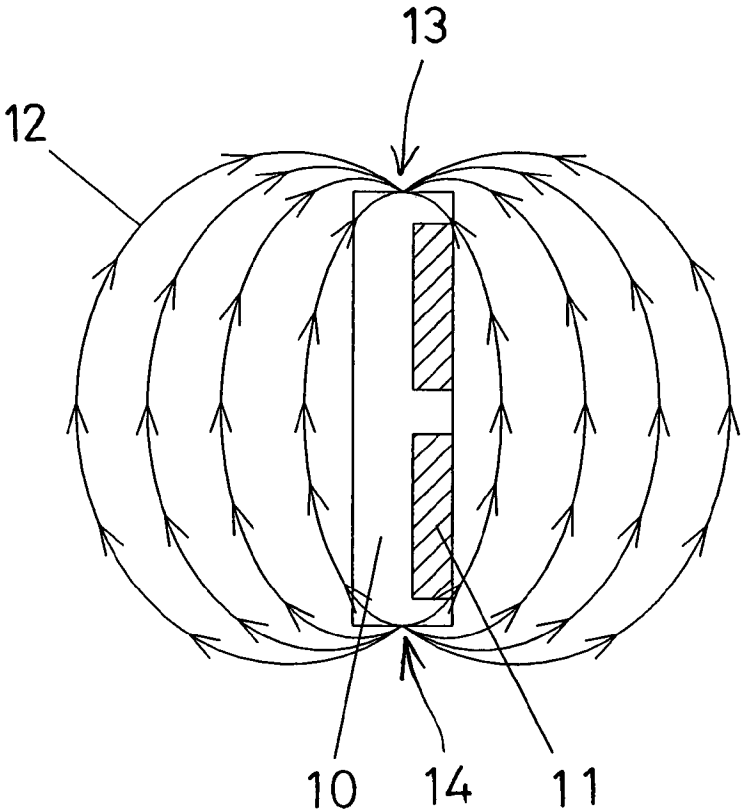
FIG. 1 PRIOR ART
FIG. 1 is a partial cross sectional view illustrating magnetic fields or signals generated by a conventional antenna device.
Figure 2:
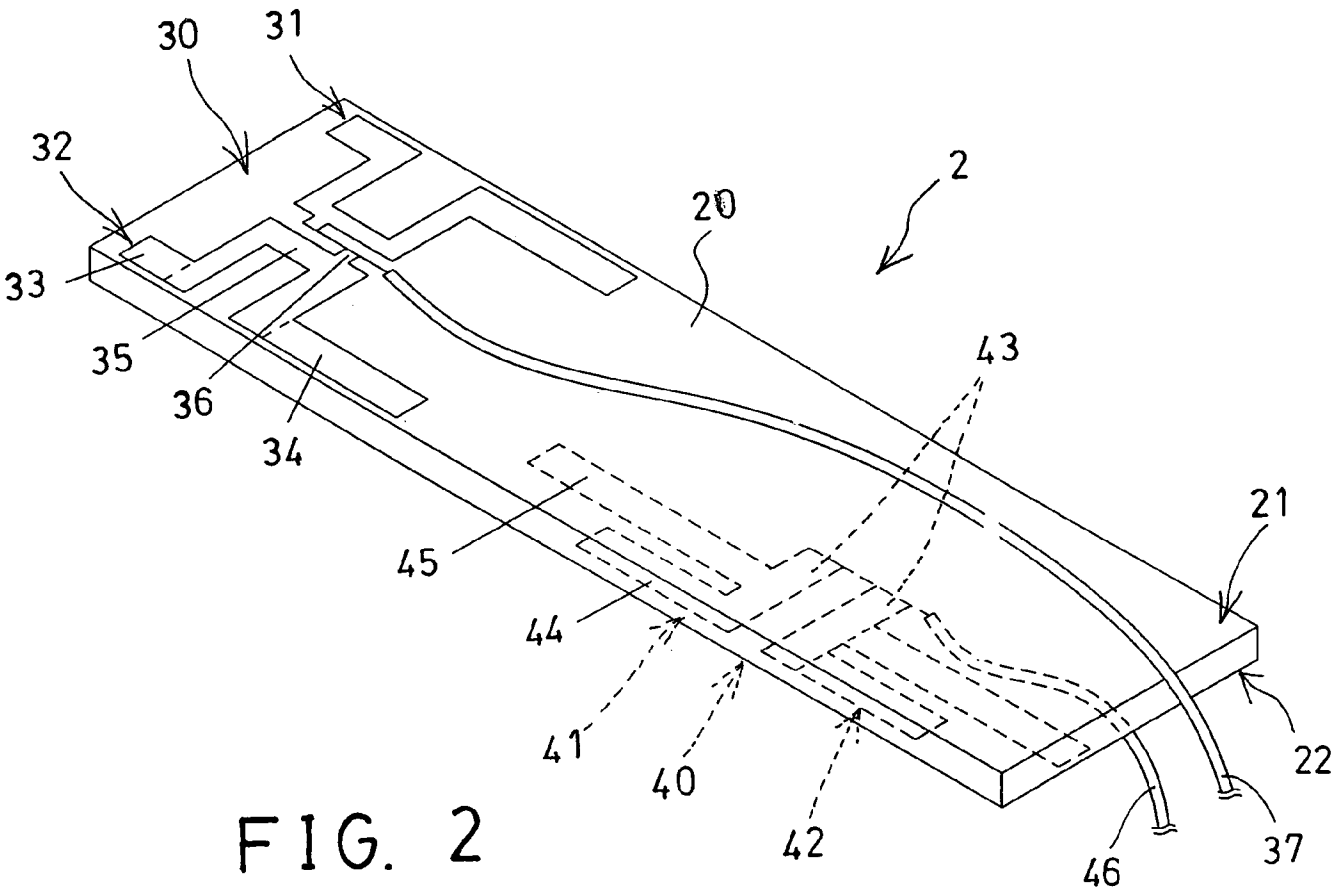
FIG. 2 is a perspective view of an antenna assembly in accordance with the present invention.
Figure 3:
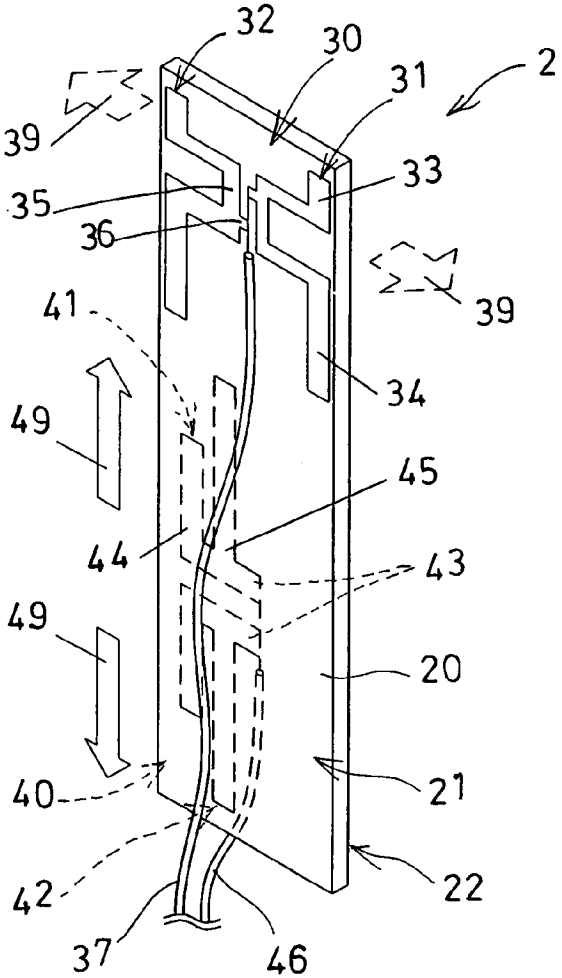
FIG. 3 is a perspective view similar to FIG. 2, illustrating the operation of the antenna assembly.

Referring to the drawings, and initially to FIG. 2, an antenna assembly 2 in accordance with the present invention comprises a circuit board 20 including two opposite sides or first and second sides 21, 22 or two opposite side surfaces 21, 22 each having an antenna device 30, 40 attached thereto, or disposed or applied thereon, for receiving and transmitting signals toward different directions, such as horizontally or laterally 39, and vertically and/or upwardly and downwardly in vertical directions 49 as shown in FIG. 3 respectively.

Each of the antenna devices 30, 40 preferably includes two antenna members 31, 32; and 41, 42, for receiving and transmitting signals toward different directions relative to each other. For example, the antenna members 31, 32 of the antenna device 30 are disposed side by side, for receiving and transmitting signals toward different lateral directions 39 relative to each other, or away from each other. The antenna members 41, 42 of the other antenna device 40 are disposed up and down relative to each other, for receiving and transmitting signals toward different vertical directions 49 relative to each other, or away from each other.

It is preferable that the antenna members 31, 32 of the antenna device 30 each includes two antenna segments 33, 34 disposed up and down relative to each other, and an intermediate and/or C-shaped antenna segment 35 disposed between the antenna segments 33, 34, for receiving and transmitting signals of different frequencies, for example. It is further preferable that the antenna segments 33, 34, 35 of the two antenna members 31, 32 are disposed side by side and/or parallel to each other, or arranged in mirror symmetric relative to each other, for receiving and transmitting signals toward different lateral directions 39 relative to each other, or away from each other.

Figure 4:
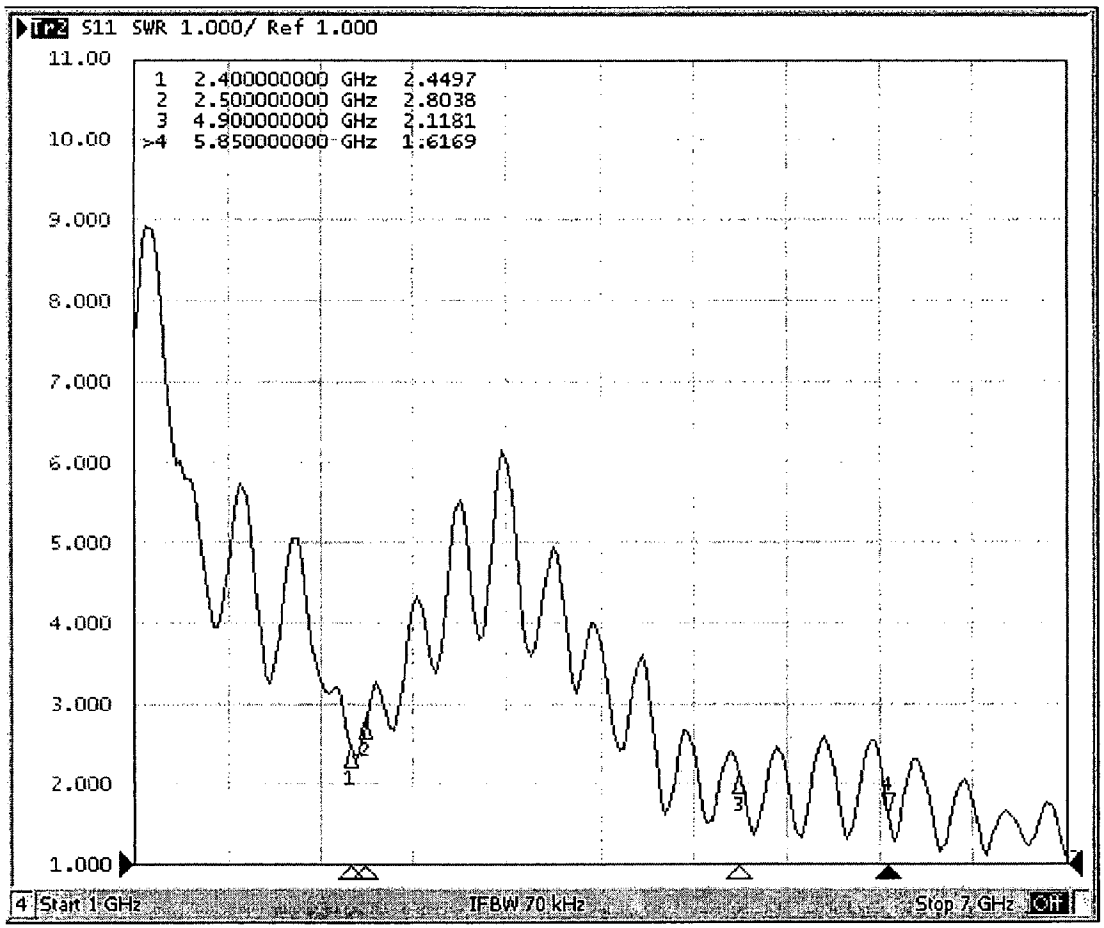
FIG. 4 is a diagram illustrating tests conducted by one of two antenna devices of the antenna assembly.

The antenna members 31, 32, such as the intermediate antenna segments 35 of the antenna members 31, 32 each includes an extension 36 extended outwardly therefrom, for coupling to an electric cable 37, and thus for coupling to various electric facilities, such as portable phones, computers, vehicle telecommunication devices (not shown), or the like. The magnetic field and/or the signals generated by the antenna members 31, 32 of the antenna device 30 have been conducted with various tests, and the results of the test have been shown in FIG. 4.

Similarly, the antenna members 41, 42 of the antenna device 40 each includes a base antenna segment 43 disposed up and down relative to each other, and two antenna segments 44, 45 extended from the base antenna segment 43 and parallel to each other, for receiving and transmitting signals of different frequencies, for example. It is further preferable that the antenna segments 43, 44, 45 of the two antenna members 41, 42 are disposed up and down relative to each other, or arranged in mirror symmetric relative to each other, for receiving and transmitting signals toward different vertical directions 49 relative to each other, or away from each other.

Figure 5:
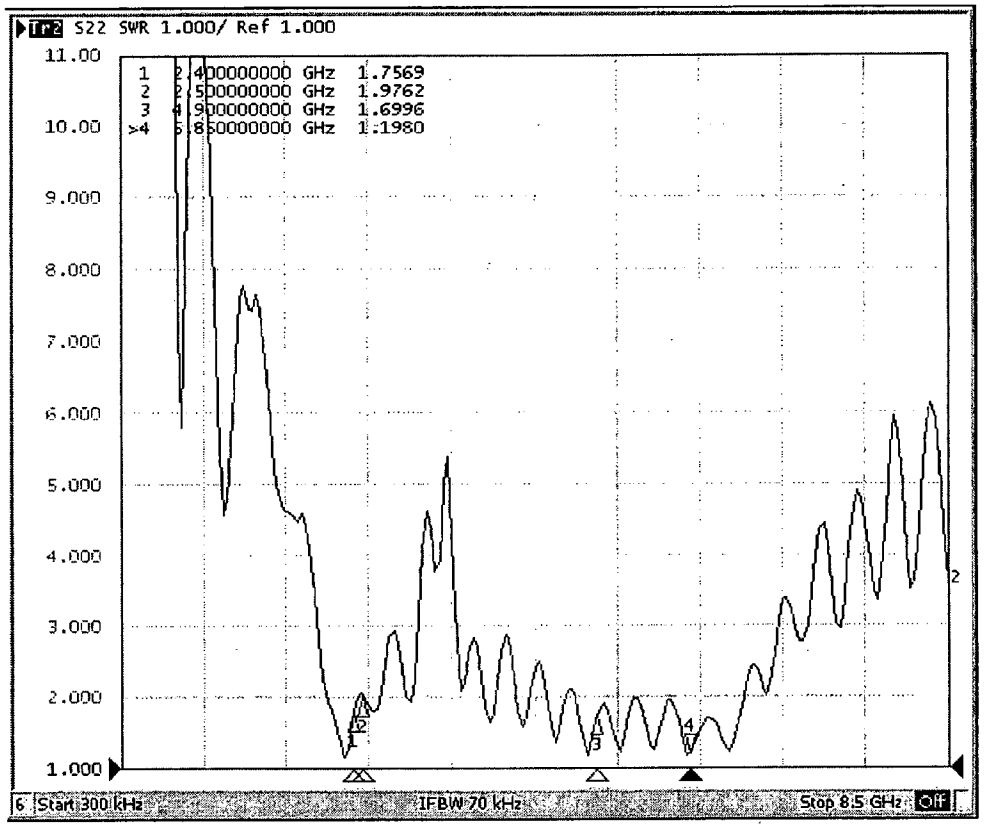
FIG. 5 is another diagram similar to FIG. 4, illustrating tests conducted by the other of the two antenna devices of the antenna assembly.

The antenna members 41, 42, such as the base antenna segments 43 of the antenna members 41, 42 each includes one end for coupling to an electric cable 46, and thus for coupling to various electric facilities, such as portable phones, computers, vehicle telecommunication devices (not shown), or the like. The magnetic field and/or the signals generated by the antenna members 41, 42 of the antenna device 40 have been conducted with various tests, and the results of the test have been shown in FIG. 5.

It is to be noted that the antenna devices 30, 40 are disposed or applied onto the two opposite sides 21, 22 or two opposite side surfaces 21, 22 of the circuit board 20, to prevent the signal receiving and transmitting operations of the two antenna devices 30, 40 from being interfered with each other. In addition, the antenna device 30 may be provided for receiving and transmitting signals toward different directions, such as horizontally or laterally 39, and the other antenna device 40 may be provided for receiving and transmitting signals toward the other different directions, such as vertically or upwardly and downwardly 49 as shown in FIG. 3 respectively, such that the signal receiving and transmitting operations of the two antenna devices 30, 40 may further be prevented from being interfered with each other.

Furthermore, each of the antenna devices 30, 40 may include two or more antenna segments 33, 34, 35; and 43, 44, 45 respectively, for receiving and transmitting signals of different frequencies, and thus for allowing the antenna devices 30, 40 to receive and transmit signals of various frequencies. There will be no dead ends or dead corners formed or generated by the antenna devices 30, 40.

Accordingly, the antenna assembly in accordance with the present invention includes two antenna devices disposed on different sides of the circuit board for receiving and transmitting signals toward different directions, such as horizontally or laterally, and vertically or upwardly and downwardly, and includes different antenna members or segments for receiving and transmitting signals of different frequencies.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An antenna assembly comprising:

a circuit board including a first side and a second side, a first antenna device disposed on said first side of said circuit board, for receiving and transmitting signals laterally, said first antenna device including two antenna members disposed in mirror symmetric relative to each other for receiving and transmitting signals toward different directions relative to each other, said antenna members of said first antenna device being disposed side by side relative to each other and each including a first antenna segment and a second antenna segment for receiving and transmitting signals of different frequencies and an intermediate antenna segment disposed between said first and said second antenna segments, said intermediate antenna segments of said antenna members of said first antenna device each including an extension extended outwardly therefrom, for coupling to an electric cable, said first and said second antenna segments of each of said antenna members of said first antenna device being disposed up and down relative to each other, and a second antenna device disposed on said second side of said circuit board, for receiving and transmitting signals vertically, to prevent signal receiving and transmitting operations of said first and said second antenna devices from being interfered with each other, said second antenna device including two antenna members disposed in mirror symmetric relative to each other for receiving and transmitting signals toward different directions relative to each other, said antenna members of said second antenna device being disposed up and down relative to each other and each including a first antenna segment and a second antenna segment for receiving and transmitting signals of different frequencies and a base antenna segment having said first and said second antenna segments extended therefrom, said first and said second antenna segments of each of said antenna members of said second antenna device being disposed side by side relative to each other, and said base antenna segments of said antenna members of said second antenna device each including one end for coupling to an electric cable.

* * * * *